US005946829A

United States Patent [19]

Quellais et al.

[11] Patent Number: 5,946,829

[45] Date of Patent: Sep. 7, 1999

[54] SNOWSHOE WITH FLEXIBLE FRAME

[75] Inventors: Jacques Quellais, Epagny; Thomas Saillet, L'orme, both of France

[73] Assignee: Salomon S. A., Metz-Tessy, France

[21] Appl. No.: 09/163,551

[22] Filed: Sep. 30, 1998

[30] Foreign Application Priority Data

Oct. 1, 1997 [FR] France ..... 97 12526

[51] Int. Cl.[6] ..... A43B 5/04

[52] U.S. Cl. ..... 36/122

[58] Field of Search ..... 36/122–125

[56] References Cited

U.S. PATENT DOCUMENTS

| | | | |
|---|---|---|---|
| 1,038,264 | 9/1912 | Baker . | |
| 3,555,707 | 1/1971 | Sharratt et al. . | |
| 3,673,713 | 7/1972 | Fedewitz . | |
| 4,203,236 | 5/1980 | Erickson et al. . | |
| 5,253,437 | 10/1993 | Kiebahn et al. | 36/122 |
| 5,540,002 | 7/1996 | Liautaud | 36/122 |
| 5,542,197 | 8/1996 | Vincent | 36/122 |

FOREIGN PATENT DOCUMENTS

| | | |
|---|---|---|
| 0613703 | 9/1994 | European Pat. Off. . |
| 52732 | 6/1911 | Switzerland . |
| 604765 | 9/1978 | Switzerland . |

*Primary Examiner*—Ted Kavanaugh
*Attorney, Agent, or Firm*—Greenblum & Bernstein, P.L.C.

[57] ABSTRACT

A snowshoe having a frame made elastically deformable due to an opening, made in its contour, providing a solution of continuity between the exterior and interior where the support piece, adapted to receive the user's boot, is located. The snowshoe is particularly well-adapted for walking on a difficult terrain that does not define a single support plane.

14 Claims, 2 Drawing Sheets

SNOWSHOE WITH FLEXIBLE FRAME

BACKGROUND OF THE INVENTION

1. Field of the Invention

The present invention relates to a snowshoe and, more specifically, to a frame structure of such a snowshoe.

2. Description of Background and Material Information

In a manner known in itself, snowshoes have a screen surrounded by a rigid frame whose closed contour defines the carrying surface, and a support piece which extends to the inside and on which the user's boot is attached. Normally, wooden snowshoe frames, possibly reinforced by a crosspiece, are closed by means of cords, straps, and/or assembly means connecting its ends after being shaped. For these snowshoes, and in order to allow the pivoting of the foot to ease walking, the support piece is connected to the flanks of the snowshoe frame and has a rotational axis extending transversely to the frame. Since the rigid frame has a closed contour and the support piece is connected transversely to its flanks, the frame cannot, by deforming itself, adapt to the layout of the terrain with respect to the natural transverse balance position of the user's foot, especially on sloped terrain.

Consequently and almost generally, it is the support piece which is provided with a possibility of transverse and vertical displacement allowing to at least partially redress the transverse balance position of the foot when the snowshoe is laterally inclined.

Such is the case, for example, of snowshoes whose screen and rotational axis of the support piece are constituted of hide cut up in cords. Indeed, because of the flexibility-suppleness of these cords, the user's foot can cause the boot to tilt laterally on the heaviest side with the support piece by deforming the cords.

This is also the case of the snowshoe described in U.S. Pat. No. 5,253,437, where the frame has a rigid tubular structure, defining a closed contour, with a support piece having transverse strips on which the boot is supported. In the case of the snowshoe taught by European Patent Application No. 0 613 703, the solution is different from the preceding examples in that the attachment of the boot is made on a support piece that has a second rotational axis extending longitudinally to the frame, i.e., oriented perpendicularly to the rotational axis allowing the pivoting of the foot in the walking direction.

In this construction, the support piece can tilt laterally, on the side where the load applied thereon by the foot is exerted, like a balance beam, consequently allowing to at least partially redress the transverse balance position of the foot in a manner comparable to the previously disclosed snowshoes.

The result of the aforementioned state of the art is that the structure with a closed contour frame requires providing a support piece for the boot that is relatively flexible due to the use of cords, despite the risks of rapid wear, or that is provided with a second rotational axis, despite the ensuing complexity of construction.

In summary, the frames of known snowshoes always remain fixed and nondeformable in the plane of the carrying surface that they define given their rigidity and closed contour, and it is the support piece that is fitted to allow correcting the lateral setting of the user's foot. This way of designing snowshoes, therefore, offers solutions that are more or less satisfying in providing a good support position for the foot on sloped terrain, but still presents the disadvantage of not allowing the frame to adapt to the layout of the terrain, which has a negative effect on gripping, especially when one walks on slopes and relatively hard snow.

Another disadvantage relates to manufacturing costs, since a closed contour frame structure requires implementing specific assembly means to guarantee that the frame will hold its shape, for example, strips, cords, welding, nut-screw systems, etc., on the one hand, and specific means for allowing the support piece to at least partially redress the natural transverse balance position of the foot when the snowshoe is placed on a slope, on the other hand.

SUMMARY OF THE INVENTION

The present invention provides for remedying these various drawbacks and includes, as an object, the following:

- allowing an adaptation of the snowshoe frame as a function of the terrain configuration due to a possibility of elastic deformation which it has from one flank to the other and with respect to the support piece;
- allowing the at least partial redressing of the natural transverse balance position of the user's foot with respect to the snowshoe frame on sloped terrains by the lateral lowering of the support piece on the side most weighed down by the foot;
- varying the height position of the support piece with respect to the frame as a function of the weight applied thereon;
- dampening pressure of the foot on the support piece when the snowshoe comes into contact with the ground, especially when waling downhill where the heel of the snowshoe touches the ground first, and when walking uphill where the user makes a substantial muscular thrust as soon as he or she bears down on the snowshoe in order to take the next step.

To achieve these objects, the snowshoe according to the invention has a screen surrounded by a frame whose contour defines the carrying surface, and a support piece extending on the inside and on which the user's boot is fixed, whereby the frame contour is open. More specifically, it has an opening offering a solution of continuity between the frame exterior and interior where the support piece is located. This opening has the object of making the parts of the frame located on both sides flexible, or more flexible, the maximum flexibility being obtained at the opening area.

Through this characteristic, the snowshoe frame is capable of being deformed differently on the two sides of the opening, and therefore of being adapted to a difficult terrain configuration, i.e., not defining a single support plane, which is translated into a better gripping.

According to a preferred embodiment, the frame has a contour which extends continuously from the zone corresponding to the front of the snowshoe to the zone corresponding to the rear of the snowshoe where the opening is located. In this ways the opening determines a relative independence and flexibility of two flanks of the snowshoe frame, all the more important as the distance increases from the front of the latter.

According to a particular feature of the invention, the support piece is connected to the flanks of the snowshoe frame by a connecting device acting as a bridge in the opening zone. This connecting device is attached directly or indirectly to the flanks of the frame so as to preserve the flexibility thereof on both sides of the opening, while providing a rotational axis oriented transversely to the frame so as to allow the pivoting of the foot to ease walking. The flanks of the snowshoe can therefore be elastically deformed independently one of the other as a function of the terrain configuration in the longitudinal and transverse direction of the snowshoe, and therefore of the support piece, without having a negative effect on the pivoting of the foot.

According to a specific example, the open contour frame has an approximate U-shape whose two arms extend into the zone corresponding to the rear of the snowshoe, their end portions being folded towards the center and in the direction of the front of the snowshoe, at a distance one from the other and substantially parallel with respect to one another, in a plane approximately parallel to that of the flanks of the snowshoe frame. In this configuration, the support piece of the boot is attached on the folded end portions of the two arms of the U which form the flanks of the frame via the connecting means which, joining them in the manner of a bridge, is assembled thereon by pivoting connections whose rotational axis is oriented in the longitudinal direction of the snowshoe frame. The flexibility and independence of the flanks of the frame are therefore maintained while allowing the support piece to tilt laterally with respect to the flanks of the frame around an imaginary rotational axis oriented in the longitudinal direction of the frame.

In fact, it is the allowed lateral tilting of the support piece which enables the at least partial redressing of the natural transverse balance position of the user's foot with respect to the snowshoe frame on sloped terrain by the lateral lowering of the support piece on the side most weighed down by the foot.

One advantage that results from this construction concerns the elastic suspension effect that the frame end portions folded inward give the support piece with respect to the flanks of the latter, and especially from the zone where the opening is located. The user's foot support on the support piece, i.e., when he or she bears down on the latter, is consequently dampened at each step after the snowshoe's touches the ground. Further, especially when walking uphill, the flexion capacity given to the snowshoe end portions folded towards the inside allows accentuating the gripping and penetration of the tip of the user's boot into the ground when he or she applies the muscular thrust necessary to bear down on the other snowshoe at each step.

Preferably, the snowshoe frame is obtained from a shaped material which extends continuously and is then shaped and/or bent. The shaped material can also have a solid or open section and consist, for example, of a tube that is folded accordingly to give it the shape of the frame.

Of course, the frame can also be made from shaped plastic materials and obtained by molding.

BRIEF DESCRIPTION OF DRAWINGS

The invention will furthermore be better understood with reference to the following description and attached schematic drawings showing, by way of example, the embodiment of a snowshoe whose frame contour is open.

DETAILED DESCRIPTION OF THF INVENTION

Figure 1:
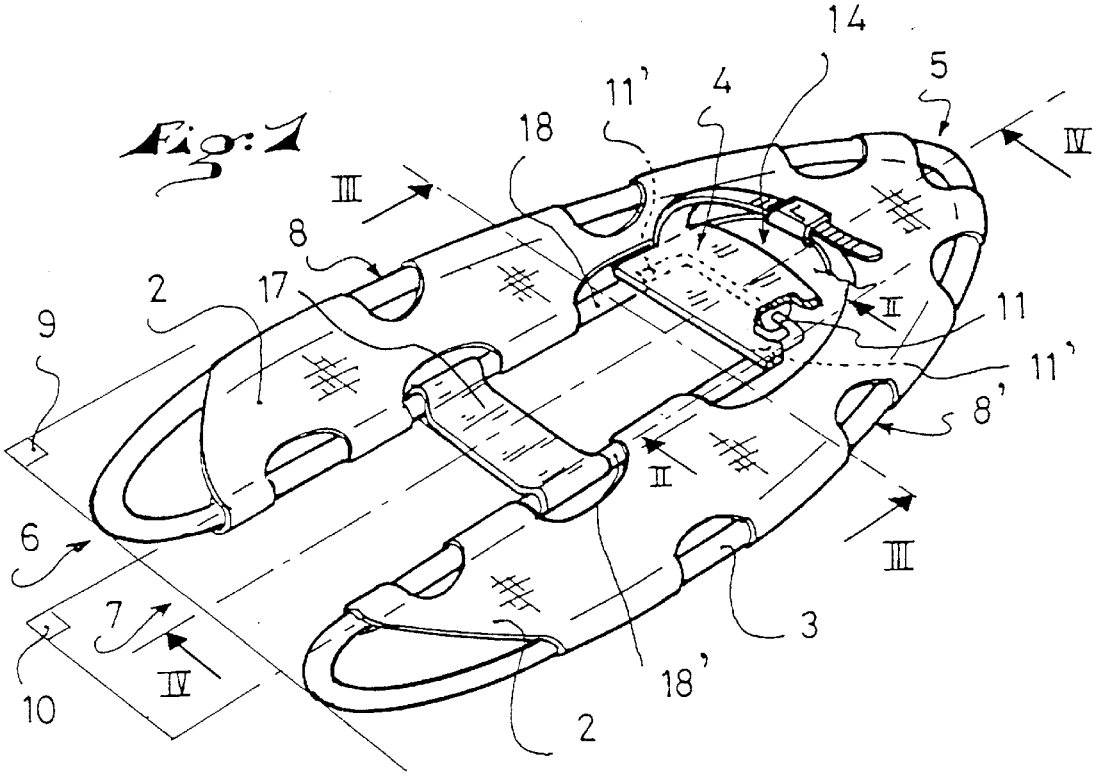
FIG. 1 shows, in a perspective and partially exploded view, an open frame snowshoe.
Figure 3:
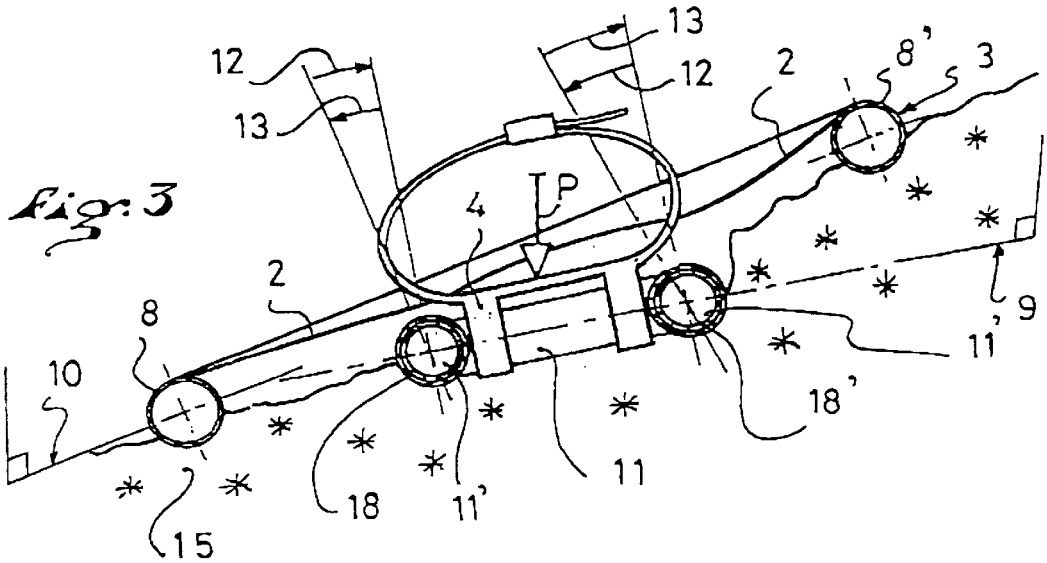
FIGS. 3 and 4 show two possibilities of elastic deformation of the snowshoe frame as a function of the ground configuration and weight applied on the support piece of the user's foot, FIG. 3 being a transverse cross-sectional view taken along the line III—III of FIG. 1, on a sloped terrain, and FIG. 4 being a longitudinal cross-sectional view along the line IV—IV of FIG. 1, on a steep slope.
Figure 4:
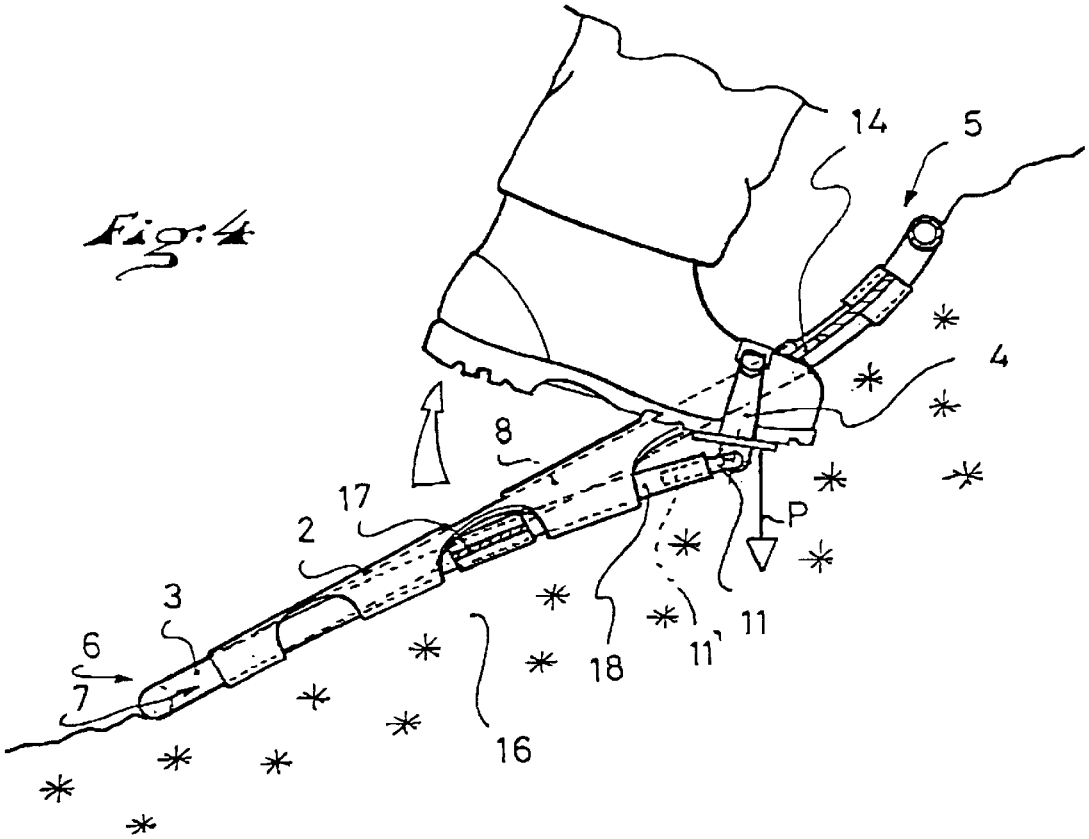

The snowshoe shown in FIGS. 1, 3, and 4 has a screen 2 surrounded by a frame 3, a support piece 4 which is located inside the latter and is adapted to receive and retain the user's boot (not shown), and a heel rest 17 arranged at a distance from the support piece 4. The contour of the frame 3 extends continuously from the front 5 of the snowshoe to the rear 6 where it has an opening 7 constituting a break separating its two flanks 8 and 8', which are thus rendered more or less flexible independently one from the other with respect to the front 5 of the snowshoe. This opening 7 is demarcated on both sides by extensions 18 and 18', extending from the flanks 8, 8' of the frame 3. These extensions 18, 18' are equipped with the support piece 4 and are oriented towards the center of the snowshoe and in the direction of the front 5 thereof. More specifically in this construction example, the frame 3 is obtained from a hollow shaped element such as a cylindrical tube and substantially has a U-shape whose two arms form the flanks 8 and 8' of the snowshoe, their end portions, or extensions, 18 and 18' being bent towards the inside of the latter, at a distance one from the other and substantially parallel with respect to one another, in a plane 9 parallel to the plane 10 defined by the flanks 8, 8' of the frame 3. According to preferred embodiments, the frame could be made from either a metallic shaped element or from a plastic shaped element.

Figure 2:
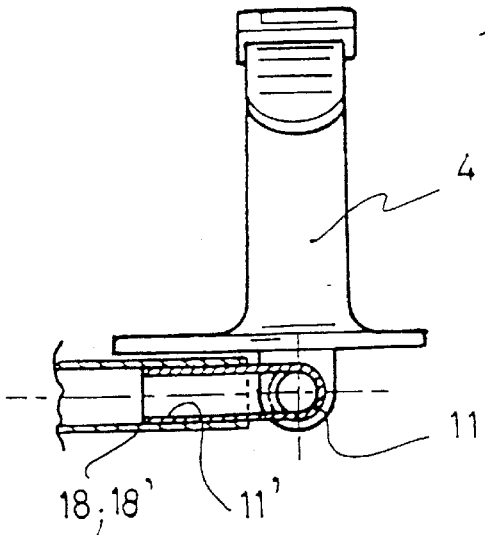
FIG. 2 shows, in a cross-sectional view taken along the line II—II of FIG. 1, a detail of the assembly of the support piece on the frame.

In this configuration, the screen 2 is extended on both sides of the opening 7 between the folded end portions 18, 18' and the flanks 8, 8' of the frame 3, and goes around the support piece 4 while defining a walking window 14 to allow passage for the tip of the boot. Therefore the snowshoe is divided from the front 5 towards the rear 6 in two distinct parts, more or less flexible, each having a certain carrying surface. The support piece 4 is attached onto the end portions 18, 18' by a U-shaped connecting arrangement 11, advantageously obtained from a cylindrical tube which, by its end portions 11', nests freely into the corresponding end portions 18, 18' as seen more specifically in FIG. 2.

In this way, the connecting arrangement 11, with the support piece 4, can vary in height position and in the direction transverse to the frame 3 by preserving the flexibility of the end portions 18, 18' and that of the flanks 8 and 8' of the frame 3. Indeed, the assembly by free nesting on these cylindrical portions 11', 18, and 18' allows their relative displacement as indicated by the arrows 12 and 13 in FIG. 3. In fact, such an assembly constitutes the equivalent of articulations whose rotational axes would be oriented in the longitudinal direction of the frame 3 of the snowshoe.

Consequently, when the snowshoe is laid on a sloped terrain 15, as shown in FIG. 3, the end portions 18, 18' bend in the lateral direction and independently one of the other, the more substantial displacement taking place on the end portion 18' located on the uphill side. The plane 9, defined by the end portions 18, 18', then comes into a position relatively close to the horizontal secant to the plane 10 defined by the flanks 8, 8' of the frame 3. The end portions 18, 18' of the two arms of the U forming the flanks 8, 8' of the frame 3 thereby give the support piece 4 the equivalent of an elastic suspension and of a lateral pivoting means whose rotational axis would be oriented in the longitudinal direction of the snowshoe.

The flexibility of the end portions 18, 18' on both sides of the opening 7 allows therefore the at least partial redressing of the natural transverse balance position of the user's foot with respect to the flanks 8, 8' of the frame 3 on sloped terrain.

Again, as shown in FIG. 4, the flexibility of the end portions 18 and 18' from the rear zone 6 of the snowshoe where the opening 7 is located allows enhancing the support taken and the gripping when walking uphill. Indeed, in this use, the transfer of the user's body weight onto the snowshoe, ie., applying a weight P, causes the flexion of the folded end portions 18, 18' and, consequently, the lowering of the support piece 4 in the direction of the ground 16. The tip of the boot, which passes through the walking window 14 of the screen 2, penetrates even further into the ground and leaves a footprint.

The tip of the boot, the support piece 4, and/or the bent end portions 18, 18' can advantageously be equipped with spikes to improve gripping.

Moreover, the snowshoe according to the invention can have devices adapted to modify its deforming capacity. For example, a detachable device can be provided to close the frame 3 of the snowshoe at the area of the opening 7 for an envisioned specific use. Selectively, the implemented detachable device can be either rigid or elastic. Thus, in the case of a rigid device, the snowshoe takes on to a behavior similar to conventional snowshoes with closed rigid frames, and in the case of an elastic device, the deformability capacity of the snowshoe frame is more limited.

Finally, the open frame snowshoe can be made differently than in the way that has just been described. In particular, the opening 7 can be made at another area than at the rear 6 of the snowshoe as, for example, at the front 5.

This application is based upon the French patent application No. 97 12526, filed Oct. 1, 1997, the disclosure of which is hereby incorporated by reference thereto in its entirety, and the priority of which is hereby claimed under 35 USC 119.

What is claimed is:

1. A snowshoe comprising:

a frame having a contour defining a carrying surface and a screen surrounded by said frame, said contour of said frame extending continuously from a front zone to a rear zone, said rear zone being formed by a pair of laterally spaced flanks with a rear opening, said flanks being connected at said front zone, whereby said contour of said frame is generally U-shaped; and a support piece for supporting a user's boot, said support piece being secured to said frame between said laterally spaced flanks wherein each of said flanks is independently flexible with respect to said front zone of said frame.

2. A snowshoe according to claim 1, wherein:

said frame comprises a shaped element forming an outer periphery extending continuously from said front zone to said rear zone to form opposite lateral sides of the snowshoe, said shaped element extending inwardly from said opposite lateral sides at said rear zone and forwardly, from said rear zone, to form two longitudinally extending, substantially parallel portions, said flanks substantially defining a plane, said substantially parallel portions of said shaped element lying substantially in said plane.

3. A snowshoe according to claim 2, wherein:

said substantially parallel portions comprise end portions terminating at forward ends of said substantially parallel portions.

4. A snowshoe according to claim 2, wherein:

each of said substantially parallel portions is respectively flexible relative to said outer periphery of said frame.

5. A snowshoe according to claim 2, wherein:

said substantially parallel portions are flexible at said inwardly extending portions at said rear zone.

6. A snowshoe according to claim 2, wherein:

said support piece for supporting a user's boot is connected by a connecting arrangement joining said substantially parallel portions, said connecting arrangement providing a transversely extending rotational axis for facilitating pivoting of the user's foot during walking.

7. A snowshoe according to claim 6, wherein:

said connecting arrangement connecting said parallel portions comprise pivoting connections having respective rotational axes oriented in longitudinal direction of said frame.

8. A snowshoe according to claim 1, wherein:

said frame is formed from a metallic shaped element.

9. A snowshoe according to claim 8, wherein:

said frame is formed from a hollow tubular shaped element.

10. A snowshoe according to claim 8, wherein:

said frame is formed from a solid shaped element.

11. A snowshoe according to claim 1, wherein:

said frame is formed from a plastic shaped element.

12. A snowshoe according to claim 11, wherein:

said frame is formed from a hollow tubular shaped element.

13. A snowshoe according to claim 11, wherein:

said frame is formed from a solid shaped element.

14. A snowshoe according to claim 1, wherein:

a heel rest is provided between said laterall spaced flanks, rearwardly spaced from said support piece.

* * * * *